US005823376A

United States Patent [19]

McGrath

[11] Patent Number: 5,823,376

[45] Date of Patent: Oct. 20, 1998

[54] NESTABLE CRATE FOR BEVERAGE BOTTLES

[75] Inventor: Patrick James McGrath, Orlando, Fla.

[73] Assignee: Alpha Holdings, Inc., Dallas, Tex.

[21] Appl. No.: 746,075

[22] Filed: Nov. 6, 1996

[51] Int. Cl.[6] ..... B65D 21/00

[52] U.S. Cl. ..... 220/516; 220/509

[58] Field of Search ..... 206/139, 427; 220/509, 516, 518, 519, 675

[56] References Cited

U.S. PATENT DOCUMENTS

| | | | |
|---|---|---|---|
| D. 252,961 | 9/1979 | Carroll et al. | D3/67 |
| 3,247,996 | 4/1966 | Garcia | 220/21 |
| 3,812,996 | 5/1974 | Bunnell | 220/21 |
| 4,773,554 | 9/1988 | Warwick | 220/21 |
| 4,899,874 | 2/1990 | Apps et al. | 206/201 |
| 5,060,819 | 10/1991 | Apps | 220/519 |
| 5,105,948 | 4/1992 | Morris et al. | 206/427 X |
| 5,184,748 | 2/1993 | Apps | 220/509 X |
| 5,337,814 | 8/1994 | Hepp | 220/509 |
| 5,372,257 | 12/1994 | Beauchamp et al. | 206/504 |
| 5,465,843 | 11/1995 | Koefelda | 206/507 |
| 5,487,487 | 1/1996 | Hammett | 220/509 |
| 5,495,945 | 3/1996 | Apps et al. | 220/516 X |
| 5,529,176 | 6/1996 | Apps et al. | 206/201 |
| 5,651,461 | 7/1997 | Apps et al. | 220/509 X |

FOREIGN PATENT DOCUMENTS

| | | | |
|---|---|---|---|
| 965056 | 3/1975 | Canada | 217/160 |
| 933480 | 11/1960 | United Kingdom . | |

OTHER PUBLICATIONS

Exhibit A1
Exhibit A2
Exhibit A3
Exhibit B

*Primary Examiner*—Steven M. Pollard
*Attorney, Agent, or Firm*—Robert L. Wolter, Esq.; Maguire, Voorhis & Wells

[57] ABSTRACT

A nestable crate for bottles having an upright retainer wall surrounding a horizontally disposed floor. The retainer wall has an upper portion, a lower portion, a vertically disposed interior surface and an exterior surface. A plurality of tangency pads are integrally formed in the upper portion of the retainer wall of its interior surface. A nesting window is formed in the interior surface of the retainer wall below each tangency pad. The crate accommodates both single bottles placed in the crate separated as well as bottle-filled cartons.

38 Claims, 12 Drawing Sheets

NESTABLE CRATE FOR BEVERAGE BOTTLES

FIELD OF INVENTION

This invention relates to plastic reusable crates for storing and transporting beverage bottles. More specifically, this invention relates to such crates that are nestable.

BACKGROUND

Beverage bottles are stored, transported, and sometimes displayed, in plastic reusable crates. Manufacturers attempt to implement several features or characteristics to efficiently transport and store both bottle-filled crates and empty crates. Two important factors include "bottle control" within the crate and "nestability" of stacked crates.

Bottle crates generally consist of a rectangular floor and an upright wall, pylons and/or columns extending along the periphery of the floor. Those crates having walls utilize the vertical surface of an interior wall to contact bottles at a tangency point, either at the base of a bottle and/or its mid-section. Forces applied to the sides of such crates direct a line of force through the line of contact of a row of bottles, and the bottles within the crate provide resistance which provides enhanced crate structural integrity.

Unfortunately, bottle shapes may inhibit the effectiveness of the vertical wall crates. Many beverage bottles have a modified cylindrical shape by which the base is somewhat bulbous and larger in diameter than the mid-section of the bottle. Moreover, the vertical wall construction may require that the interior wall be only slightly drafted (approximately 0.5°) away from the interior of the crate. In many instances, the mid-section of a bottle will have minimal contact with the side wall of a crate, if any at all. This lack of contact promotes undesirable tilting or tipping of the bottle.

The vertical wall constructions have been modified so the interior surfaces of the walls have slight indentations or pockets to accommodate the bottles; however, these constructions still lack sufficient bottle control to prevent rocking of bottle-filled stacks of crates. Moreover, the wall construction provides very limited nesting of stacked empty crates that is often limited only to the depth of the floor of the crate. Thus, it is desirable to have a crate that, when filled, controls the movement of the bottle, but also, when empty, provides maximum nesting capabilities.

Nestability is a significant variable considered in minimizing the overall storage space of empty crates. Nesting generally refers to stacking crates, whereby a bottom portion of an upper tray fits within a lower tray or vice versa. Those skilled in the art may appreciate that the higher degree of nesting between consecutively stacked crates minimizes the overall crate stack height and results in significant economies.

The U.S. Pat. No. 5,465,843, for a "Nestable Display Crate for Bottles or the Like", discloses a double-wall construction and pylons disposed around the periphery of the crate floor. The pylons in a lower tray fit within the hollow pylon construction of an upper tray.

The '843 patent includes tapered pylons that are spaced apart around the floor. The bottles are placed between the pylons. The pylons have a pyramid shape with two surfaces facing the interior of the crate. Each surface has an opening within which a portion of a bottle base nests. The base of each pylon has a "stop" intermediate consecutive bottles.

As distinguished from the wall construction which contacts the bottles at a point tangent to the sidewall, a pylon construction controls the bottles by contacting the bottles on their sides toward the interior of the crate. An outside bottle may have a tendency to rock or tip between the pylons, in part because the stop and windows provide a fulcrum point toward the base of the bottle.

In addition, clamping devices, which encompass an entire pallet of crates, are often used to transport crates. The clamping device grips the side walls of crates which may cause the pylons to flex inward and the crates to slip from the grasp of the clamping device which requires firm, preferably vertical, clamping surfaces. Thus, it is desirable to have a crate that has a retaining wall with a point contact that is directed through the line of contact of a row of bottles in a crate and high enough to avoid tipping or tilting. The intermediate position of the pylons between bottles does not provide a line of force through the line of contact of a row of bottles, and may yield allowing tilting of outside bottles between the pylons.

Furthermore, beverage bottles are sold to consumers either as individuals, or in multi-pack packages including six-pack cartons and twelve-pack cartons. Thus, it is desirable that the bottle crate is constructed to universally accommodate these cartons. A tapered pylon construction, as in the '843 patent, will not admit cartons. The cartons have cardboard vertical sides which span the area between bottles occupied by the pylons. It is desirable for a crate to accommodate both the individual, or loose, bottles and the multi-bottle carton.

SUMMARY OF THE INVENTION

It is an object of the present invention to provide a beverage bottle crate that is nestable when empty crates are stacked. Preferably an upper crate will nest to about half the height of a lower crate.

Another object of this invention is that the nestable crate will accommodate not only beverage singles but also variety-pack cartons.

Still another object of this invention is to control and minimize movement of the bottles within the crate.

Yet another object of this invention is to provide such a crate constructed from plastic with all parts integrally connected whose structure is strong, durable, reusable and resistant to deformation under all expected forms of loading.

These and other objectives are achieved with a crate having a floor and an upright retainer wall extending along the periphery of the floor. The retainer wall has an upper portion and a lower portion and also includes an interior surface and an exterior surface. The retainer wall has a plurality of tangency pads integral an upper portion of the interior surface of the retainer wall and a nesting window below each tangency pad. A nesting step is formed between consecutive tangency pads. A plurality of spaced-apart wall sections define each nesting window. The wall sections and tangency pads have coplanar vertical surfaces defining the vertically disposed interior surface of the retainer wall. In as much as the tangency pads and wall section define a vertical interior surface, beverage cartons fit within the crate as well as loose single beverage bottles.

In one embodiment the retainer wall includes an interior wall and exterior wall integrally formed and connected by a top wall to form a double wall construction. A shoulder connects the upper exterior wall portion with the lower exterior wall portion. The shoulder has a defined radius toward the interior of the crate. Thus, the cross sectional width of the upper portion of the retainer wall is narrower than the cross sectional width of the lower portion of the retainer wall. The upper wall portions of a lower crate fit within the lower wall portions of a crate stacked atop the lower crate.

The nesting window and nesting step also facilitate nesting between stacked crates. When an upper crate is stacked atop a lower crate, each tangency pad from the lower crate mates with a corresponding window in the upper crate. Similarly, the nesting step provides a space to accommodate a corresponding wall section.

The above described crate structure also minimizes bottle movement. The base of a beverage bottle rests within the windows in the lower portion of the interior surface of the retainer wall. The nesting window prevents rotation of the bottle. The surface of the tangency pad contacts the bottle at a tangent point on the bottle tangent with respect to the retainer wall. Force applied to the retainer wall directs a line of force through the line of contact in a row of bottles.

DETAILED DESCRIPTION OF THE DRAWINGS

Figure 7:
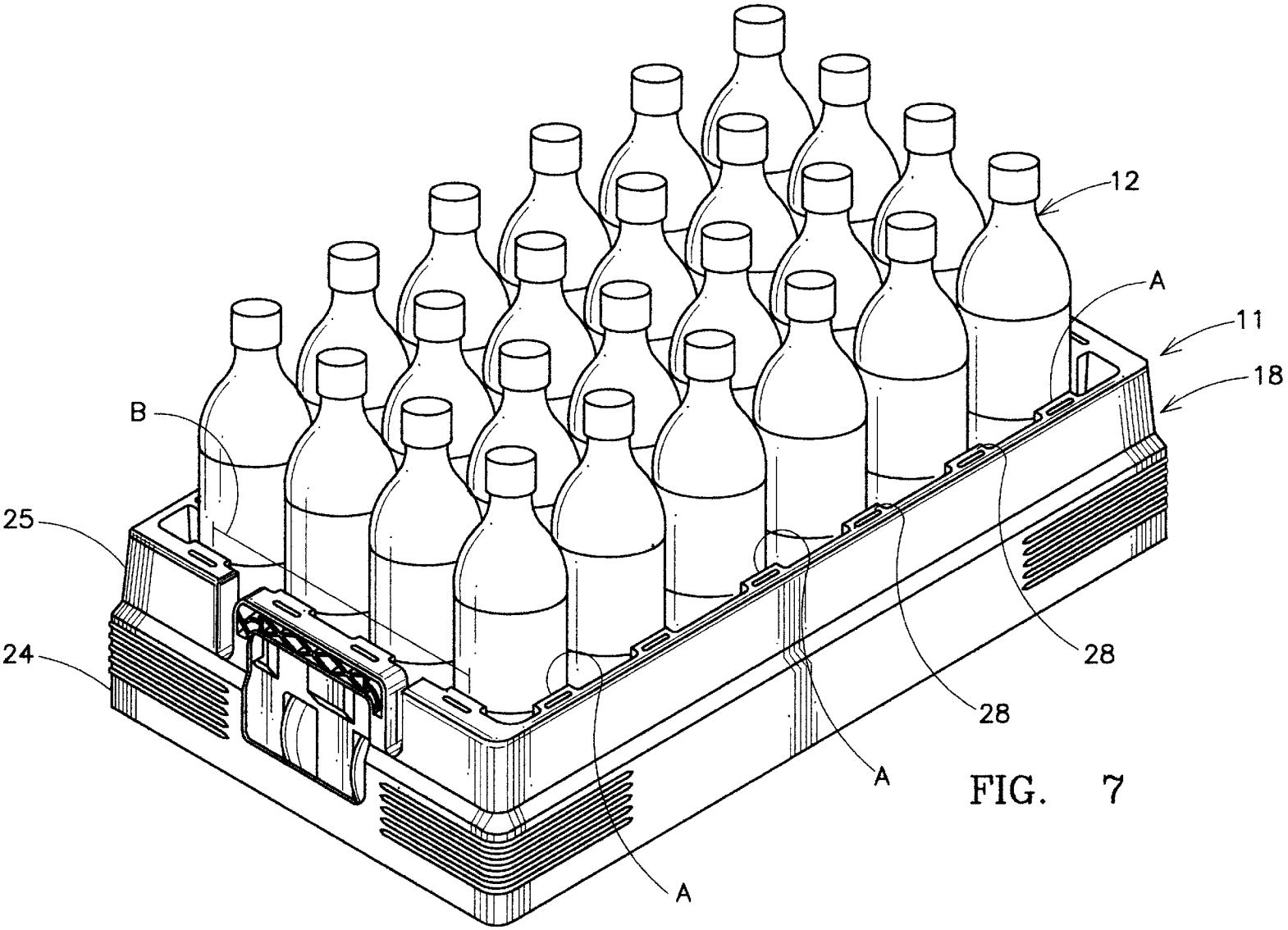
FIG. 7 is a perspective view with singles stored in the beverage bottle crate.
Figure 8:
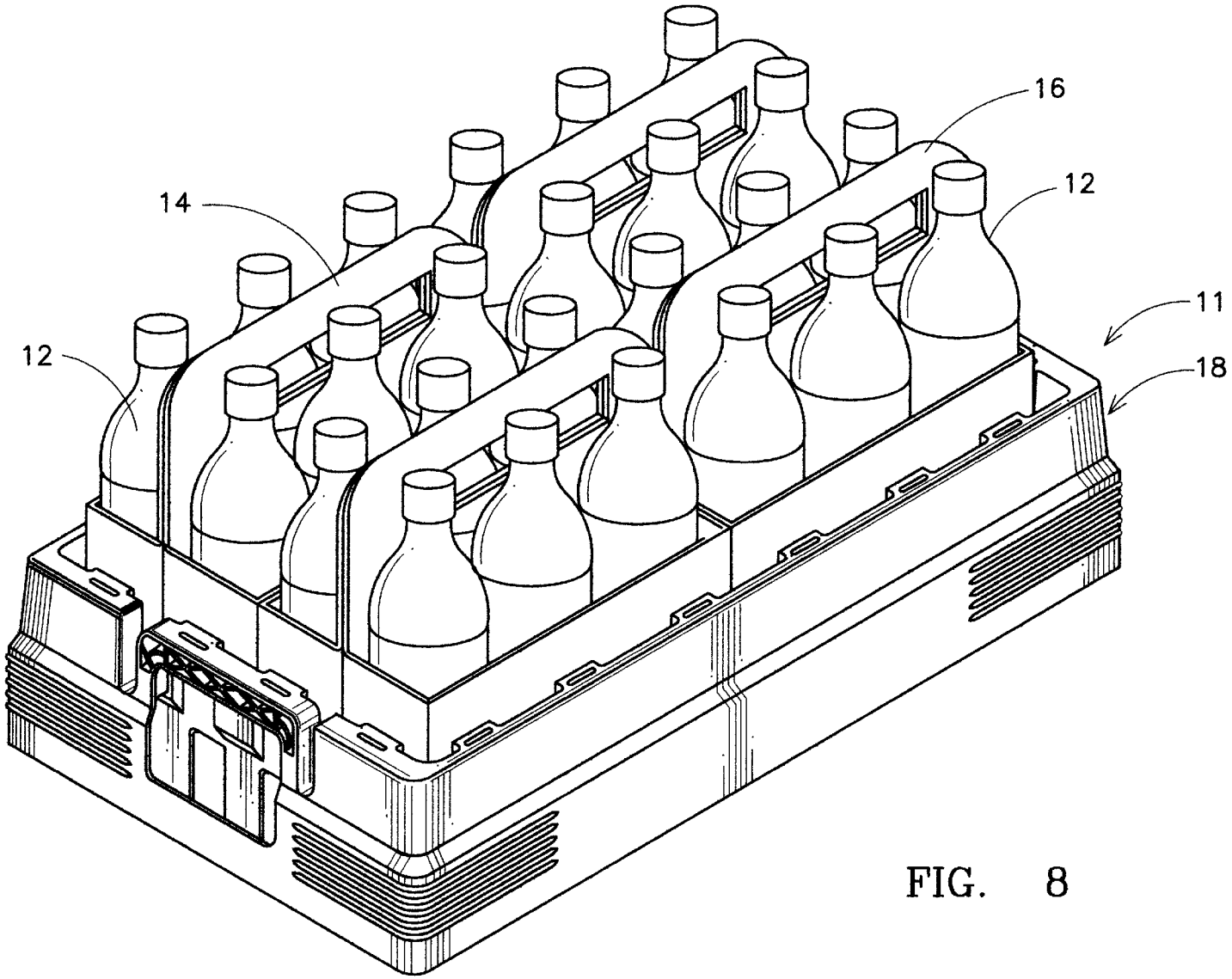
FIG. 8 is a perspective view the beverage bottle crate with six-pack cartons.
Figure 9:
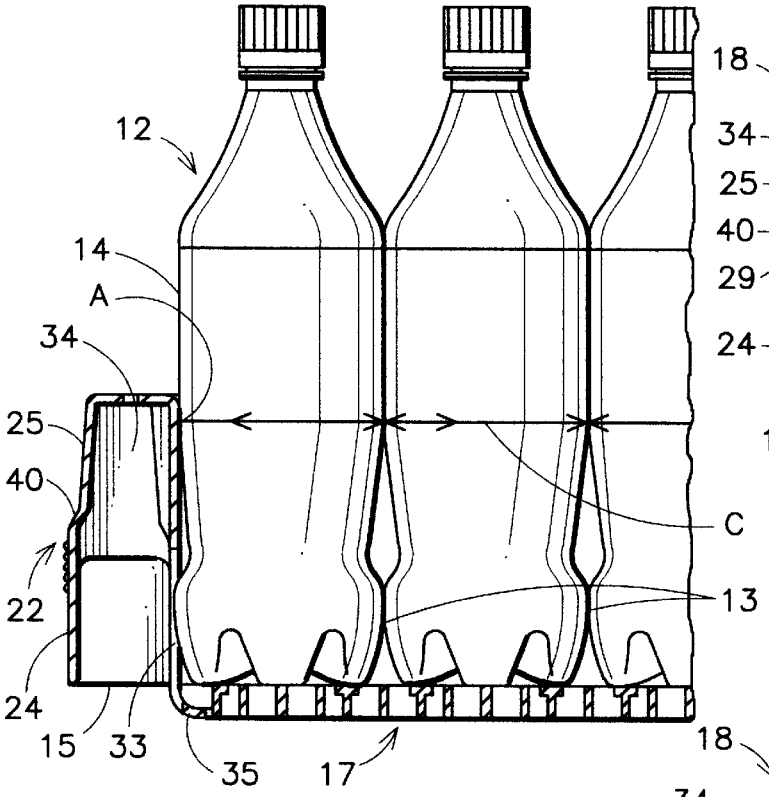
FIG. 9 is cross-sectional view taken along line 9—9 in FIG. 7.
Figure 15:
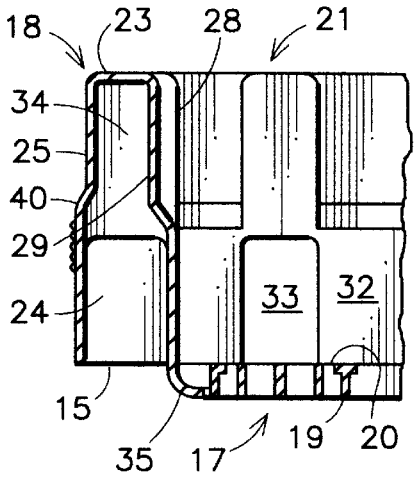
FIG. 15 is a cross-sectional view taken along line 15—15 in FIG.10.
Figure 13:
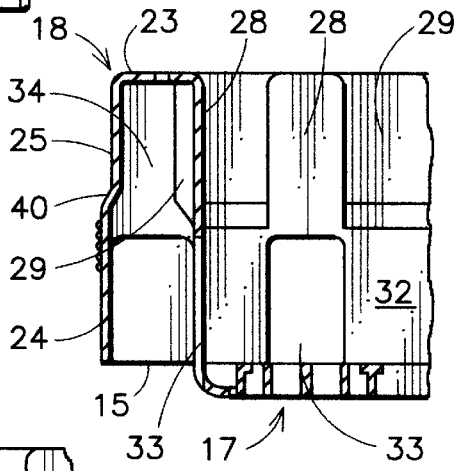
FIG. 13 is a cross-sectional view taken along line 13—13 in FIG. 1.

The invention is generally depicted in FIGS. 1–5 as a nestable crate 11 for beverage bottles. Beverage bottles 12 are shown in FIG. 9. The particular bottle shape shown is a commonly used twenty ounce bottle. The bottle includes a base 13 that has a bulbous shape, and a mid section 14. The diameter of the base 13 is slightly larger than the diameter of the mid section 14. The crate 11 will store the bottles 12 as singles, separately placed within the tray, or within cartons 16, as shown in FIGS.7 and 8 respectively. As one skilled in the art may appreciate the use of this crate 11 is not limited to a size or shape of a beverage bottle.

The crate 11 is constructed from a plastic material in an injection molding process. The entire crate is preferably formed as a single unit with all elements integrally connected. This specification discloses four embodiments of the crate 11, but it is not intended to be limited to these four embodiments. Each of the embodiments of the crate 11 includes a floor 17 and an upright retainer wall 18 integral the floor extending around the periphery of the floor 17. The floor has a bottom surface 19 and a top surface 20. The retainer wall 18 has an upper portion 25 and a lower portion 24 as well as an interior surface 30 and an exterior surface 31.

Figure 2:
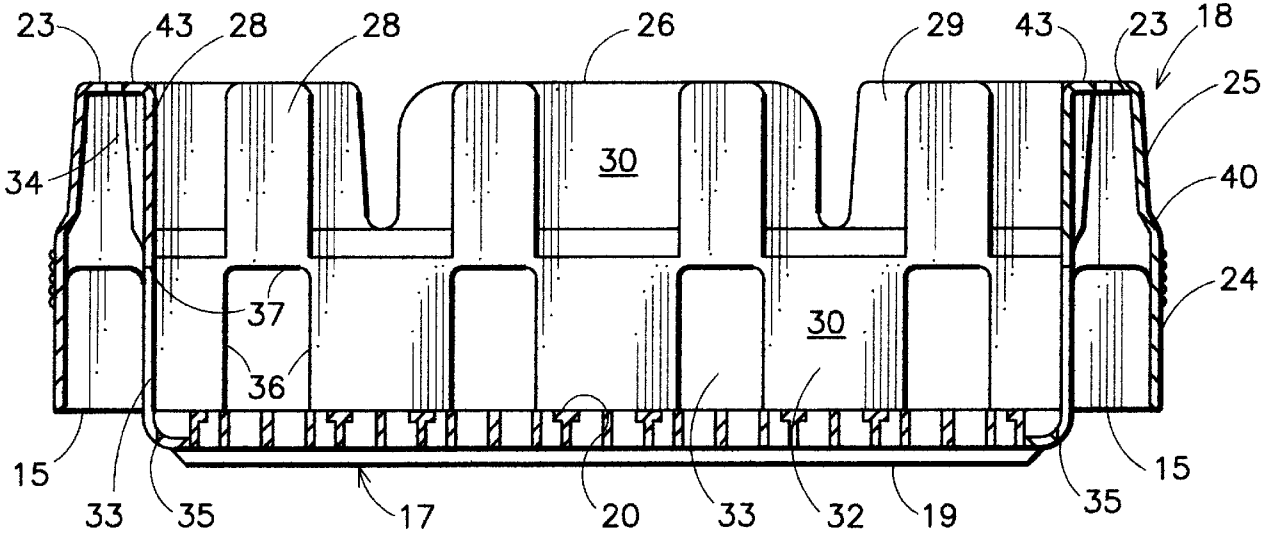
FIG. 2 is a cross-sectional view taken along line 2—2 in FIG. 1.
Figure 3:
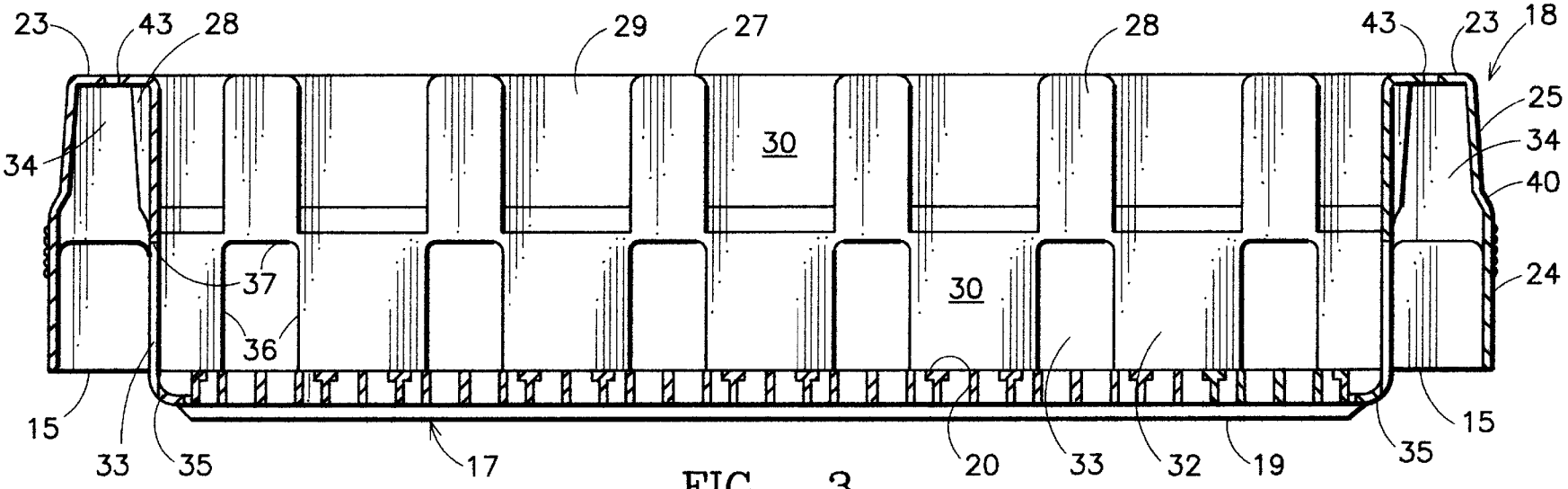
FIG. 3 is a cross-sectional view taken along line 3—3 in FIG. 1.

The first embodiment disclosed is depicted in FIG. 1–13 and includes a retainer wall 18 having a double wall construction that includes an interior wall 21 and an exterior wall 22. The retainer wall 18 has a top 23 integrally connected to the interior wall 21 and exterior wall 22 to form the double wall construction. Each of the interior wall 21 and exterior walls 22 has a lower wall portion 24 and an upper wall portion 25. The FIGS. 2 and 3 are cross-sectional views of the crate 11 illustrating slats 34 that extend intermediate the interior wall 21 and exterior wall 22 to provide a rigid structure.

Figure 1:
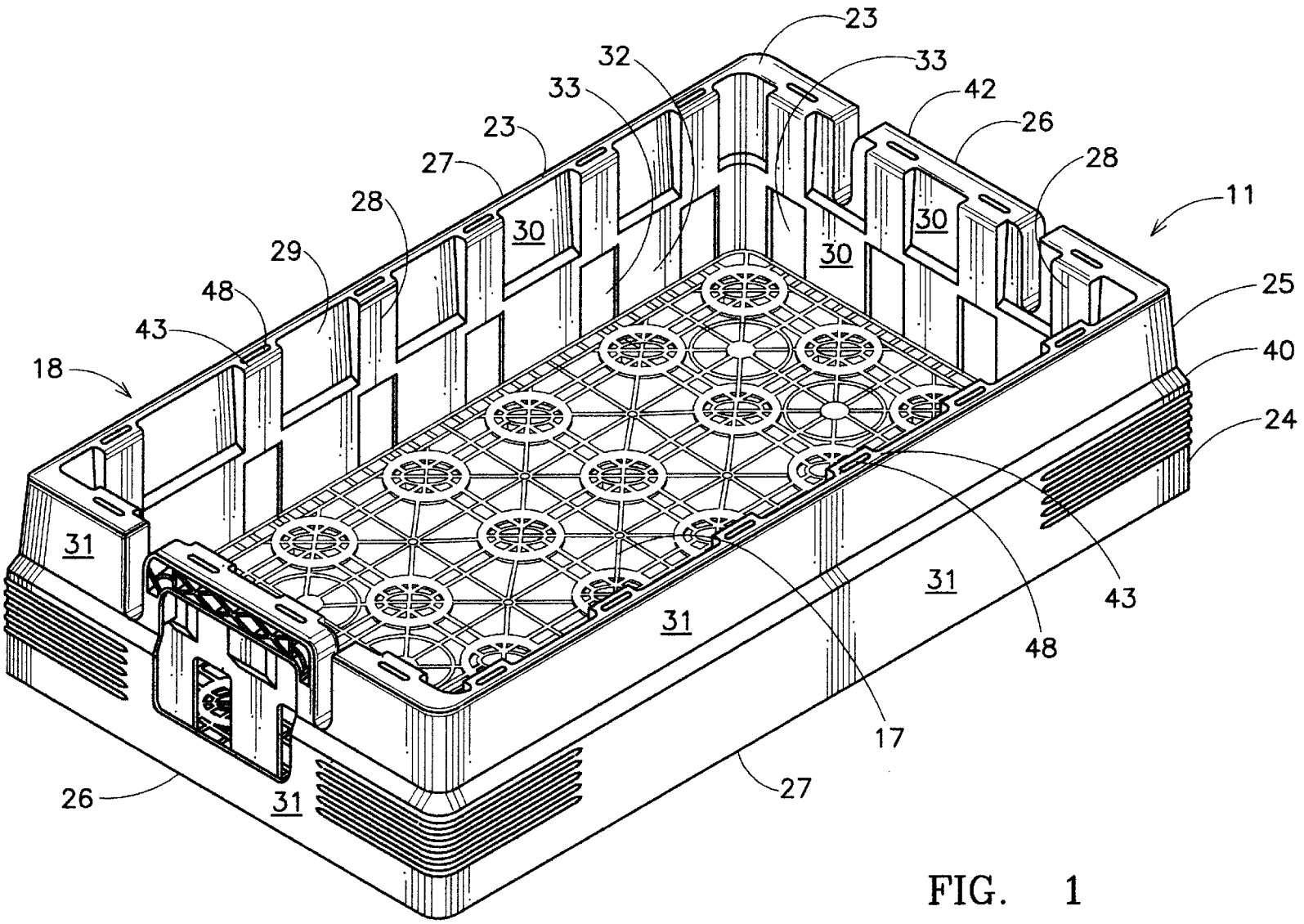
FIG. 1 is a perspective view of the beverage bottle crate.

The crate 11 may have any variety of shapes, but the shape generally used and shown in FIGS. 1 is substantially rectangular. Thus, the retainer wall 18 includes two end walls 26 and two side walls 27. The side walls 27 and end walls 26 are integrally connected forming a continuous retainer wall construction.

The floor 17 includes a standard lattice configuration having a series of integrally connected members to support the bottles 12. The bottom surface 18 includes indentations, in which bottle tops fit, when a crate 11 is stacked on a bottle filled crate 11. As best shown in the cross-sectional views of FIGS. 2, 3, 9, 13 and 15, the retainer wall 18 has a bottom edge 15 and the floor 17 is secured to the retainer wall 18 by a support member 35 so the top surface 20 of the floor is flush with the bottom edge 15 of the retainer wall 18 and depends below the bottom edge 15 of the crate 11. The support member 35 extends along the periphery of the floor 17 intermediate the retainer wall 18 and the floor 17.

A plurality of tangency pads 28 are integrally formed in the interior surface 30 of retainer wall 18 and spaced apart along the upper portion 25. A nesting step 29 is formed in the interior surface 30 along the upper portion 25 of the retainer wall 18 intermediate consecutive tangency pads 28. The tangency pad 28 has a top surface 43 that is integral the top 23 of the retainer wall 18. A slit 48 is formed in top of retainer wall 18 adjacent to each tangency pad. These slits 48 permit drainage of liquids for cleaning the crate 11.

A rectangular opening, or nesting window, 33 is positioned directly below each tangency pad 28. Wall sections 32 are formed in the lower portion 24 of the interior wall 21 and are spaced apart about the periphery of the floor 17.

The nesting steps 29 formed in the interior surface 30 of the retainer wall 18 create the spaced apart tangency pads 28. similarly, the windows 33 formed below each tangency pad 28 creates the spaced-apart wall sections 32 below each nesting step 29. In as much as the wall sections 32 and tangency pads 28 are formed from a interior surface 30 of the retainer wall 18, the tangency pads 28 have a vertically disposed surface that is coplanar with a vertically disposed surface of the wall sections 32. These surfaces of the wall sections 32 and tangency pads 28 define the vertically disposed interior surface 30 of the retainer wall 18.

Figure 14:
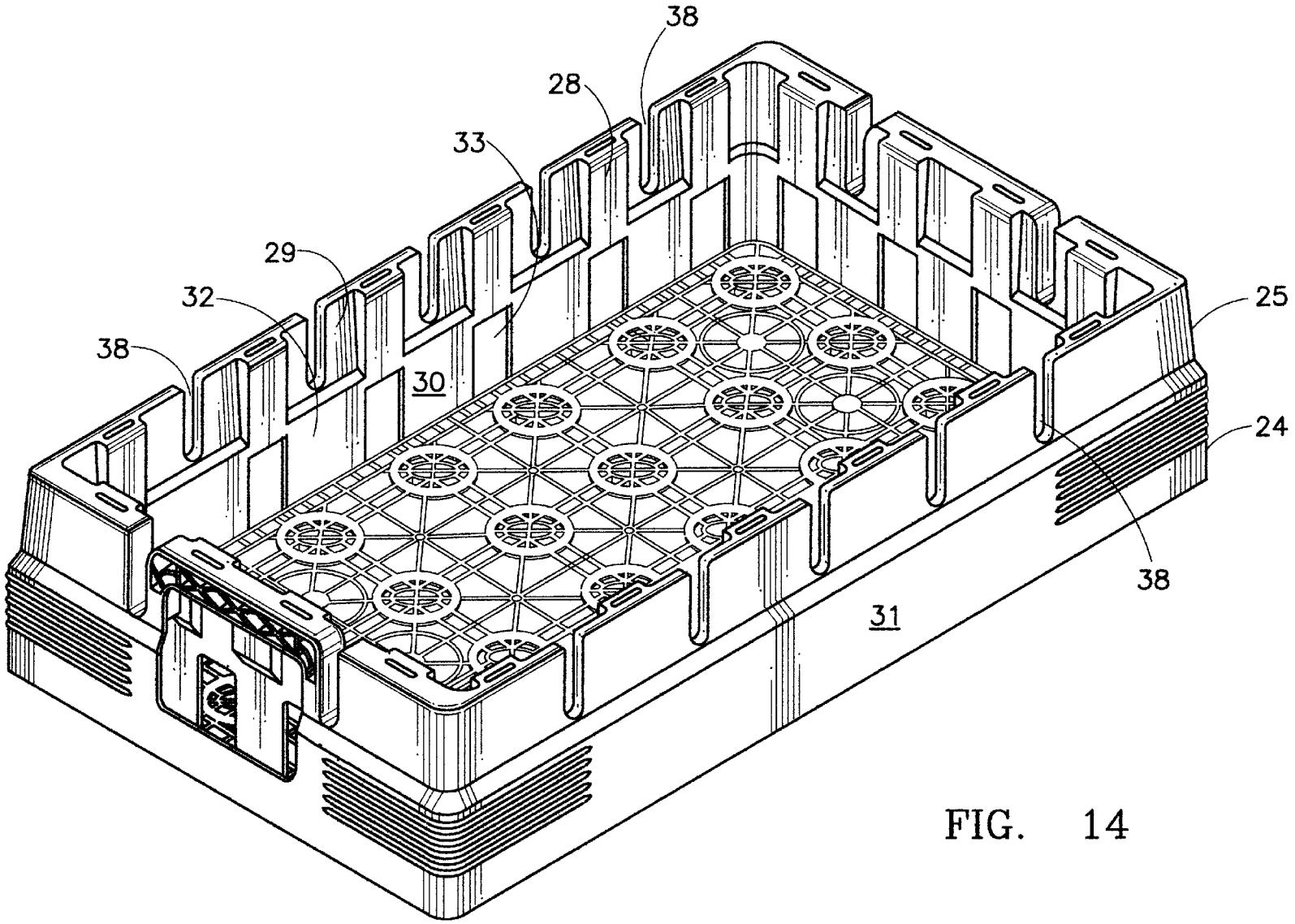
FIG. 14 is a perspective view of a third embodiment of the beverage bottle crate.
Figure 16:
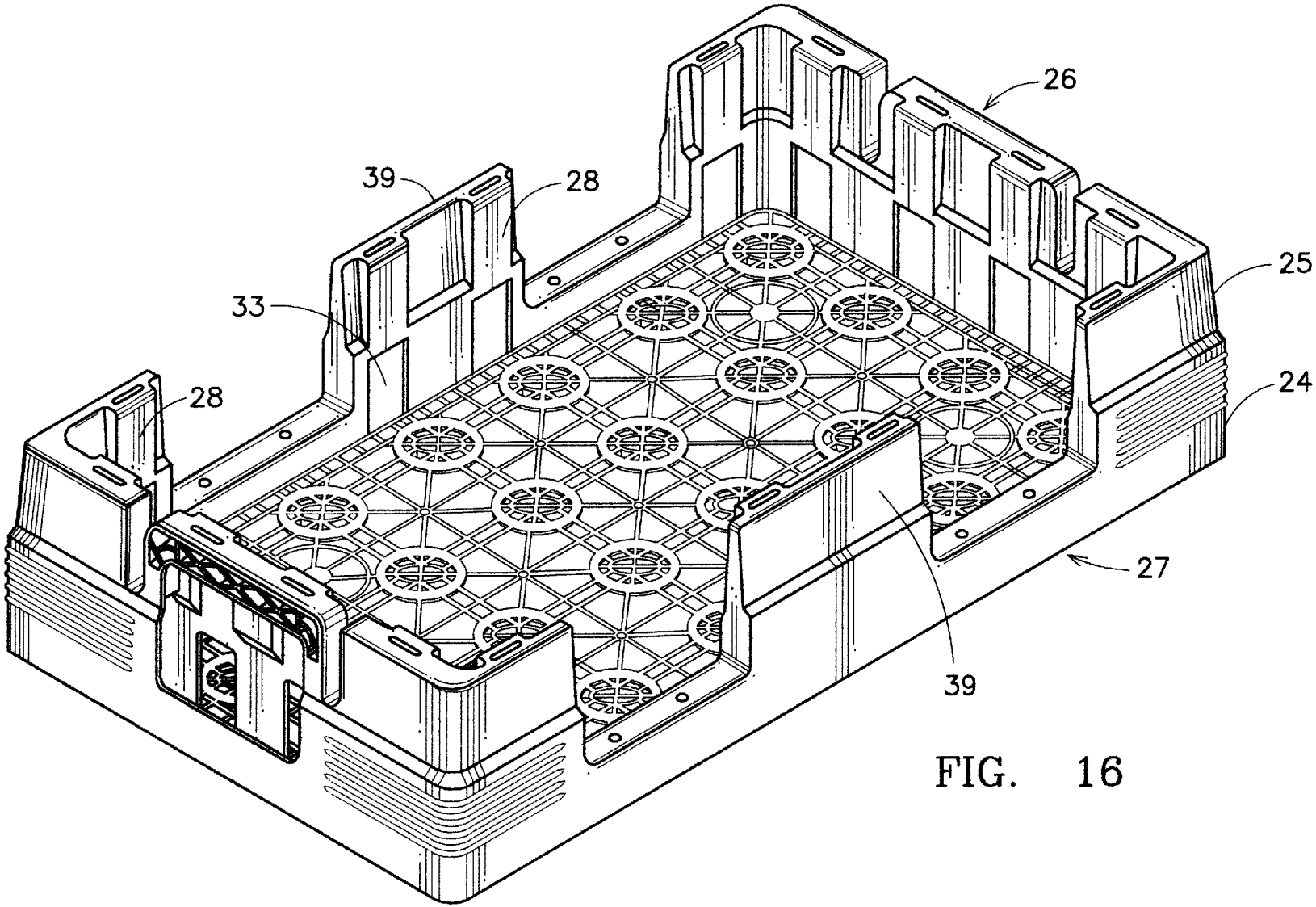
FIG. 16 is a perspective view of a third embodiment of the beverage bottle crate.

In the double wall construction depicted in each of the FIGS. 1, 14 and 16 the lower wall portion 24 of the retainer wall 18 has a greater cross-sectional width than the upper wall portion 25. A shoulder 40 is intermediate, and integral, the upper portion 25 and lower portion 24 of the retainer wall 18 and extends along the entire retainer wall 18. The shoulder 40 has a radius R that extends toward the interior of the crate 11. As noted above, the surfaces of the tangency pads 28 and the wall section 32 are coplanar; in as much as the upper portion of the wall is positioned toward the interior wall 21 from the exterior wall 22, the lower portion 24 of the retainer wall 18 has a cross-sectional width greater than the upper portion 25 of the retainer wall 18.

Figure 10:
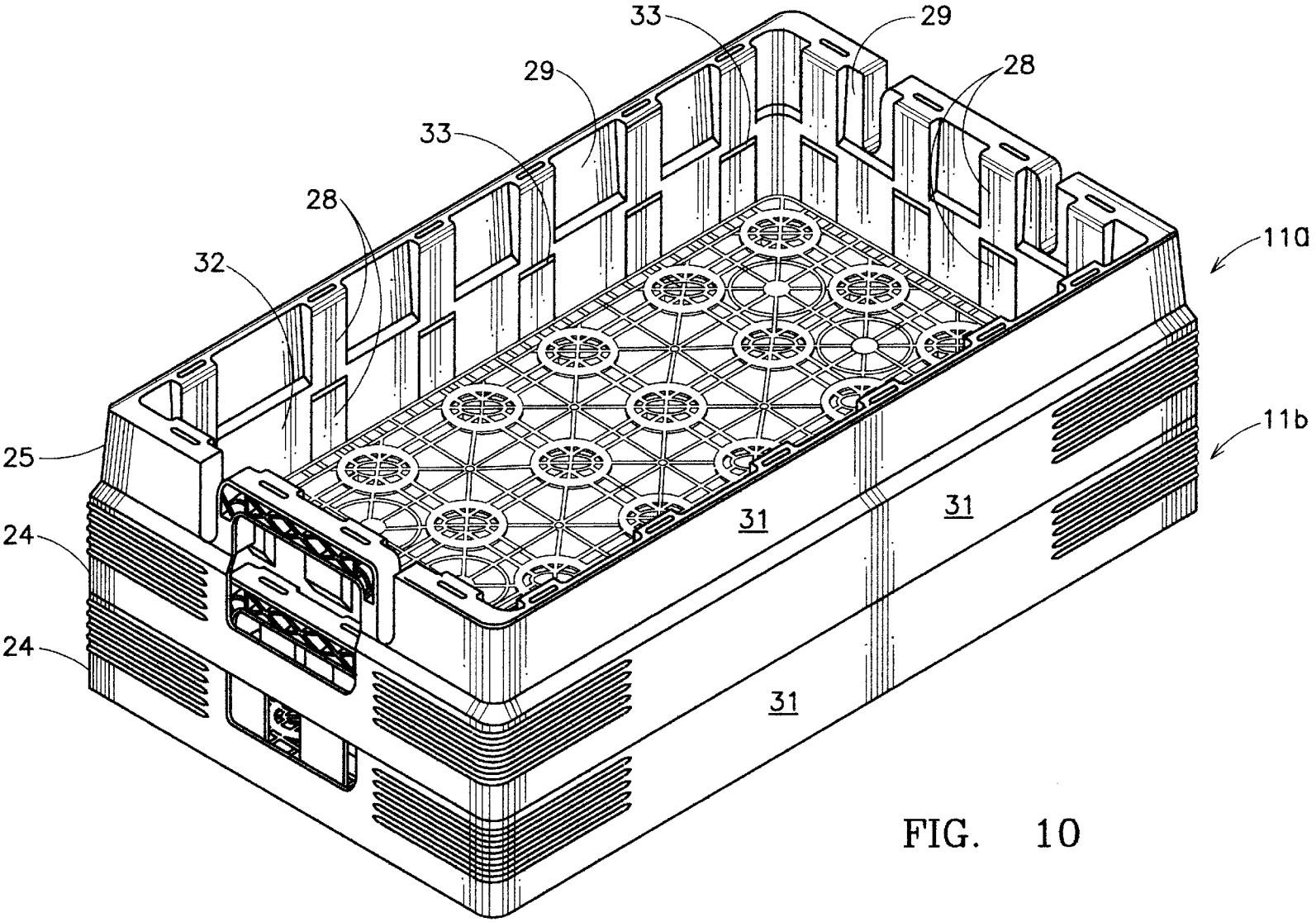
FIG. 10 is a perspective view of two stacked beverage bottle crates.

The above referenced structure of the upright retainer walls 18, including the double wall construction, tangency pads 28, nesting windows 33, wall sections 32 and nesting steps 29 facilitate the nesting of a plurality of crates 11. As shown in FIG. 10, there is a perspective view of two stacked crates 11*a* and 11*b* illustrating nesting. The cross-sectional view shown in FIG. 11, and the exploded view of FIG. 12, also show nesting. The hollow structure of the double wall construction allows the upper wall portion 25 of a retainer wall 18 of the bottom crate 11*a* to fit within the lower wall portion 24 of the top crate 11*b*. The slats 34 in the upper portion 25 of the retainer wall 18 on the upper crate 11*b* rests on the top 23 of the retainer wall 18 of the lower crate 11*a*. The bottom edge 15 of the retainer wall 18 on the upper crate 11*b* rests on the shoulder 40 of the lower crate 11*a*.

Figure 11:
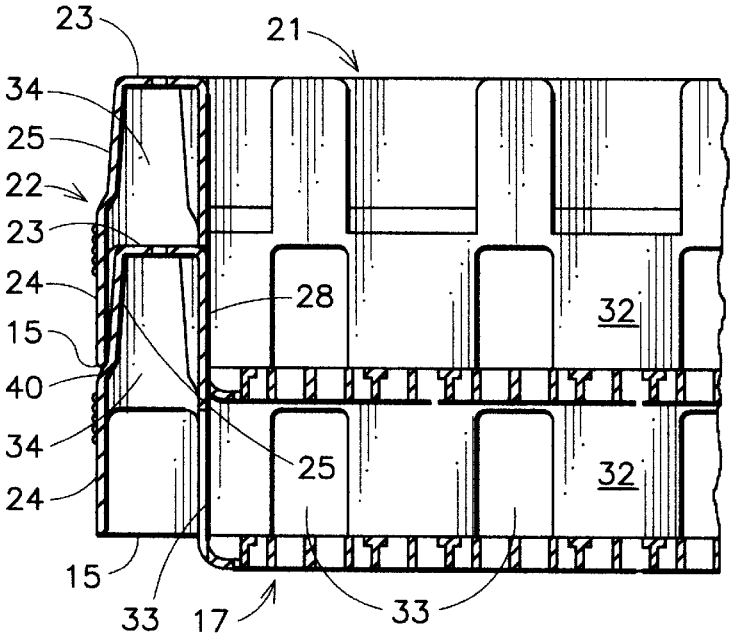
FIG. 11 is a cross sectional view taken along 10—10.
Figure 12:
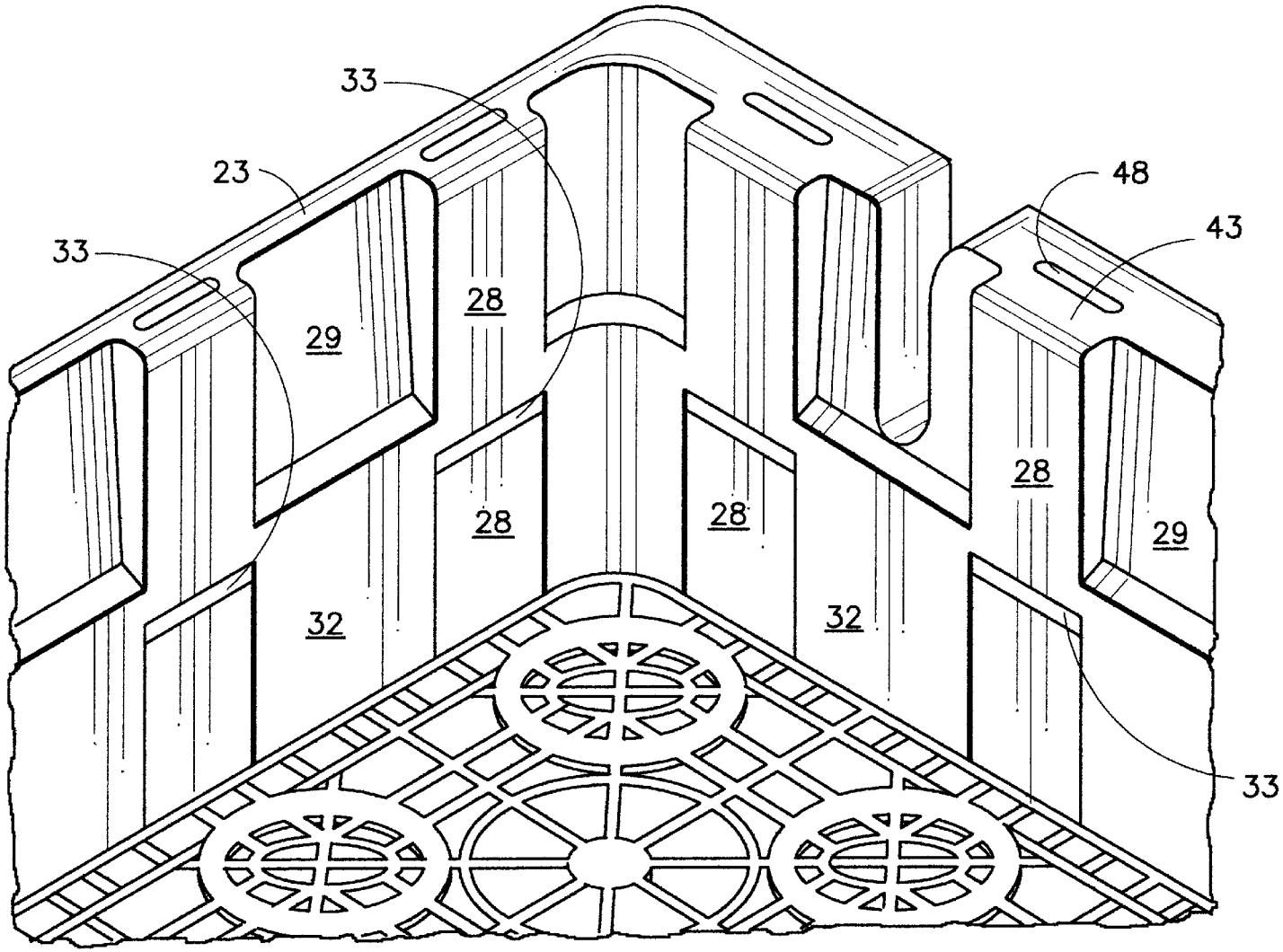
FIG. 12 is an expanded view of interior corner of the beverage bottle crate.

As shown in FIGS. 10, 11 and 12, when the crates 11*a* and 11*b* are stacked atop one another, each tangency pad 28 of the bottom crate 11*a* mates with a corresponding window 33 of the top crate 11*b*. Each wall section 32 of the top crate 11*b* rests adjacent a corresponding nesting step 29. The nesting step 29 must be effectively displaced toward the exterior wall 22 to accommodate a wall section 32 from a lower crate 11*b* so the crates 11*a* and 11*b* adequately nest. With this alignment of walls and surfaces the upper crate 11*b* will nest to one half the height of the lower crate 11*a*.

The upper portion 24 of the exterior wall 22 may be inclined slightly approximately 4° from vertical toward the crate 11 interior. The lower portion 24 of the exterior wall 22 is substantially vertical, and only approximately 0.5° from vertical as necessary to remove the crate 11 from a mold. Similarly, the tangency pads 28 and wall sections 32 on the interior wall 21 have vertically disposed surfaces that are inclined only 0.5° from vertical necessary to remove the crate 11 from a mold. The nesting step 29 may be inclined 4° from vertical extending upward toward the top 23 of the wall 18.

While the above-identified surfaces on the upper portion 25 of the retainer 18 wall may be inclined, it is not required for nesting. The upper portion 25 of the exterior wall 22 and the nesting step 29 may be vertically disposed as well. The surface of each of these walls may be only 0.5° from vertical necessary to remove the crate 11 from a mold. The base of the nesting step 29 may be horizontally displaced sufficiently from the interior surface 30 of the retainer wall 18 toward the exterior wall 22 to accommodate space for the wall sections 32 for nesting.

Movement of bottles 12 within the crate 11 is controlled by the tangency pads 28 and the windows 33 contact with the bottles 12. In FIG. 7, there is shown a crate 11 filled with loose bottles 12. The cross-sectional view in FIG. 9 illustrates that the tangency pad 28 contacts a bottle 12 at approximately its mid section 14. The base 13 of the bottles 12 rest within the window 33 of the crate 11.

With respect to FIGS. 7 and 9, a tangency pad 28 contacts each bottle 12 adjacent the retainer wall at a point A on the mid section 14 of the bottle 12. The contact points A between the bottles form a line of contact B between the retainer wall 18 and the bottles 12 that is parallel to the interior surface 30 of the retainer wall 18. The tangency pad 28 directs a line of force through the line of contact C in a row of bottles 12. The bottles 12*a* and 12*b* provide resistance to a force applied at the tangency pad 28. This is especially advantageous when crates 11 are gripped by the end walls 26 or side walls 27 by clamping devices. When the force is applied to the retainer wall 18, the bottles 12 contact with the tangency pad 28 and oppose the flexure of the retainer wall 18 toward the interior of the crate 11.

Each nesting window 33 has opposing vertical edges 36 and a top horizontal edge 37. The vertical edges 36 inhibit rotation of the bottle 12 within the crate. The top edge 37 of the nesting windows and the adjacent bottles 12 inhibit the bottle 12 from tilting toward the interior of the crate 11.

Figure 4:
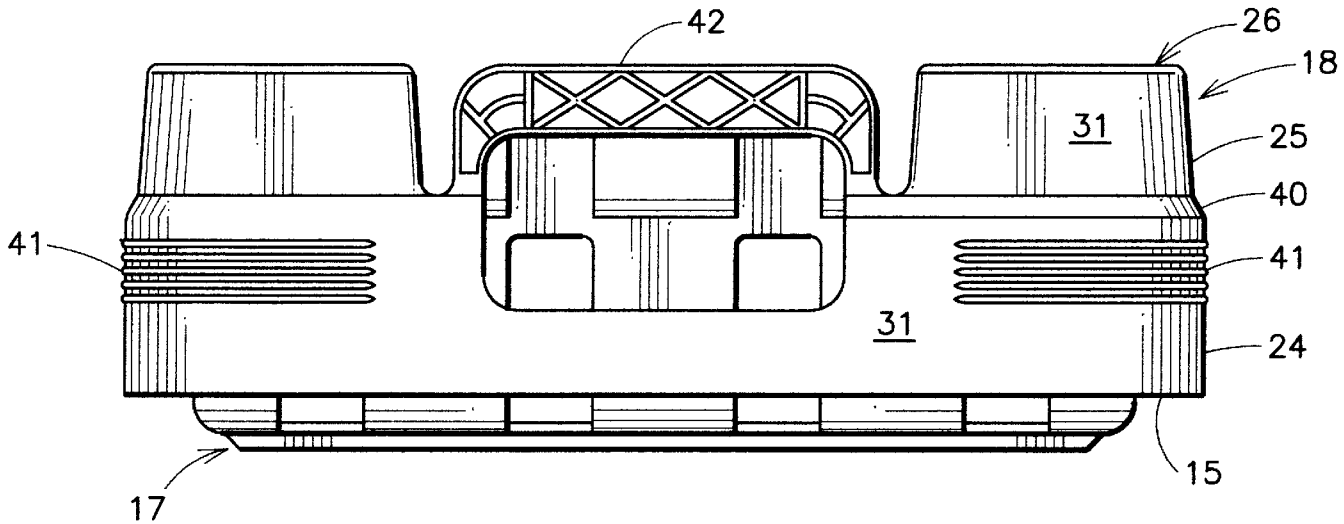
FIG. 4 is an elevational view of an exterior end wall.
Figure 5:
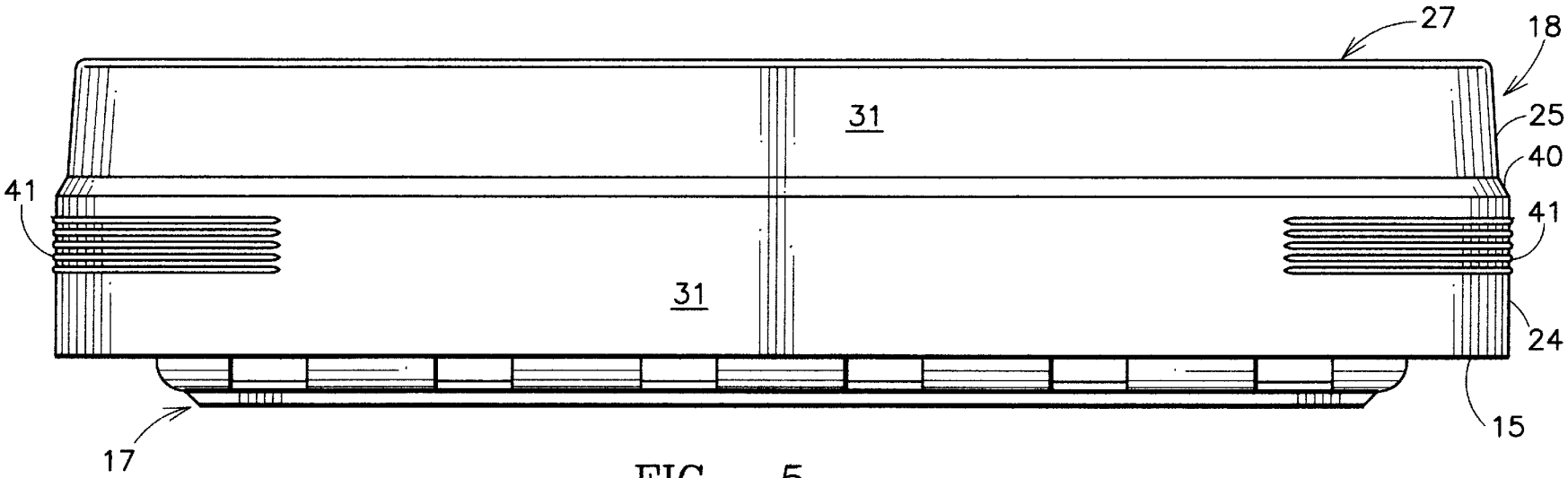
FIG. 5 is an elevational view of an exterior side wall.
Figure 6:
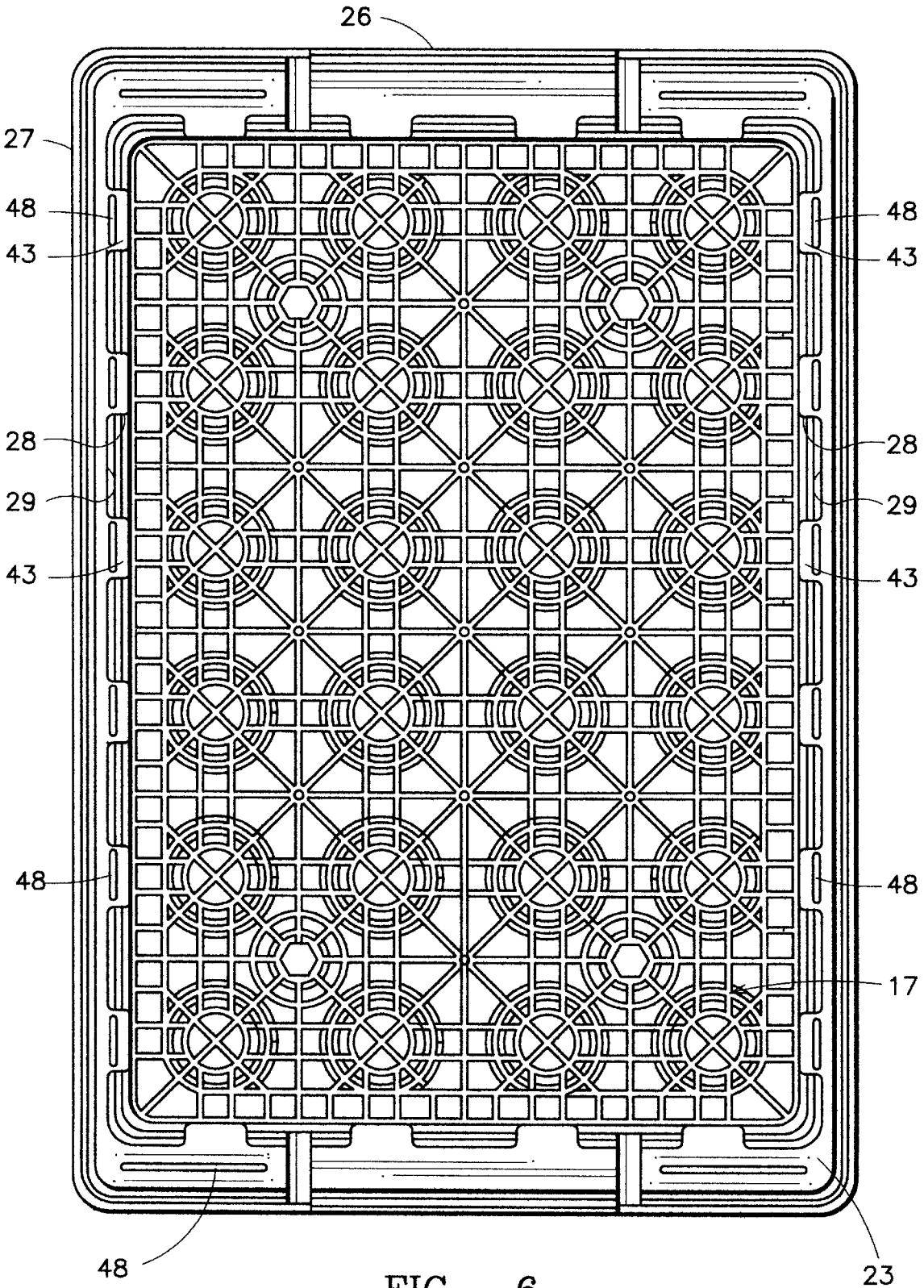
FIG. 6 is a top view of the crate.

With respect to FIGS. 4 and 5 the ribs 41 serve as a locking mechanism for crates 11 stored side-by-side and end-to-end. The ribs 41 on respective diagonally aligned corners of the crate 11 are attached to the retainer wall at the same height. The ribs 41 on consecutive corners shown in FIGS. 4 and 5 are aligned so the ribs 41 of a tray aligned aside the crate 11 fit within recesses between the ribs 41 of an adjacent crate 11.

Handles 42 are formed in each of the end walls 26 of the crate 11. A portion of the exterior wall 22 is simply removed to form the handle 42. The interior wall 21 remains intact and tangency pads 28, wall sections 32 and windows remain on the interior wall 22 and interior surface 30 adjacent the handle.

With respect to FIG. 8, four six-pack cartons 16 having bottles 12 are placed within the crate 11. Trays having a pylon construction may hold loose bottles; however, these crates 11 may not hold cartons 16 with bottles 12. The vertically disposed interior surface 30 of the interior wall 21 does not impinge upon the span of the carton 16 between the bottles 16 because the crate 11 controls the bottles by contacting bottles 12 at tangency points on the mid section 14 of the bottles 12. Moreover, despite the fact the carton 16 covers the base 13 of the bottle 16, the carton is flexible enough so the base 13 will rest in the window 32.

In reference to FIG. 14, there is illustrated an embodiment of the beverage bottle crate 11 with notches 38 formed in the nesting step 29 intermediate consecutive tangency pads 28. Slats 34 are intermediate the external wall 21 and interior wall 22 to support the retainer wall 18 and extend from the bottom edge 15 of the retainer wall to the top 23 of the retainer wall 18. The notches 38 are formed in the retainer wall 18, so when the crates 11 are stacked atop one another, the notches 38 receive the segment of the slats 34 in the lower wall portion 24 of the retainer wall 18.

Another embodiment is illustrated in FIG. 16. In this particular embodiment, segments of the retainer wall 18 are removed for viewing the six-pack cartons 16 labels. A middle section 39 of each side wall 27 remains. This middle section 39 has two tangency pads 28 and a corresponding window 33 under each pad 28. Each end wall 26 has a single tangency pad 28 remaining from the side wall 27. Therefore, there are four pads on each side of the crate. As the bottles are maintained in cartons 16, the bottle 12 aligned in the gap 39 will be controlled by the cartons 16 and, to some degree, by the other bottles 12 the tangency pads 28 and windows 33 contacting the other bottles 12.

Figure 17:
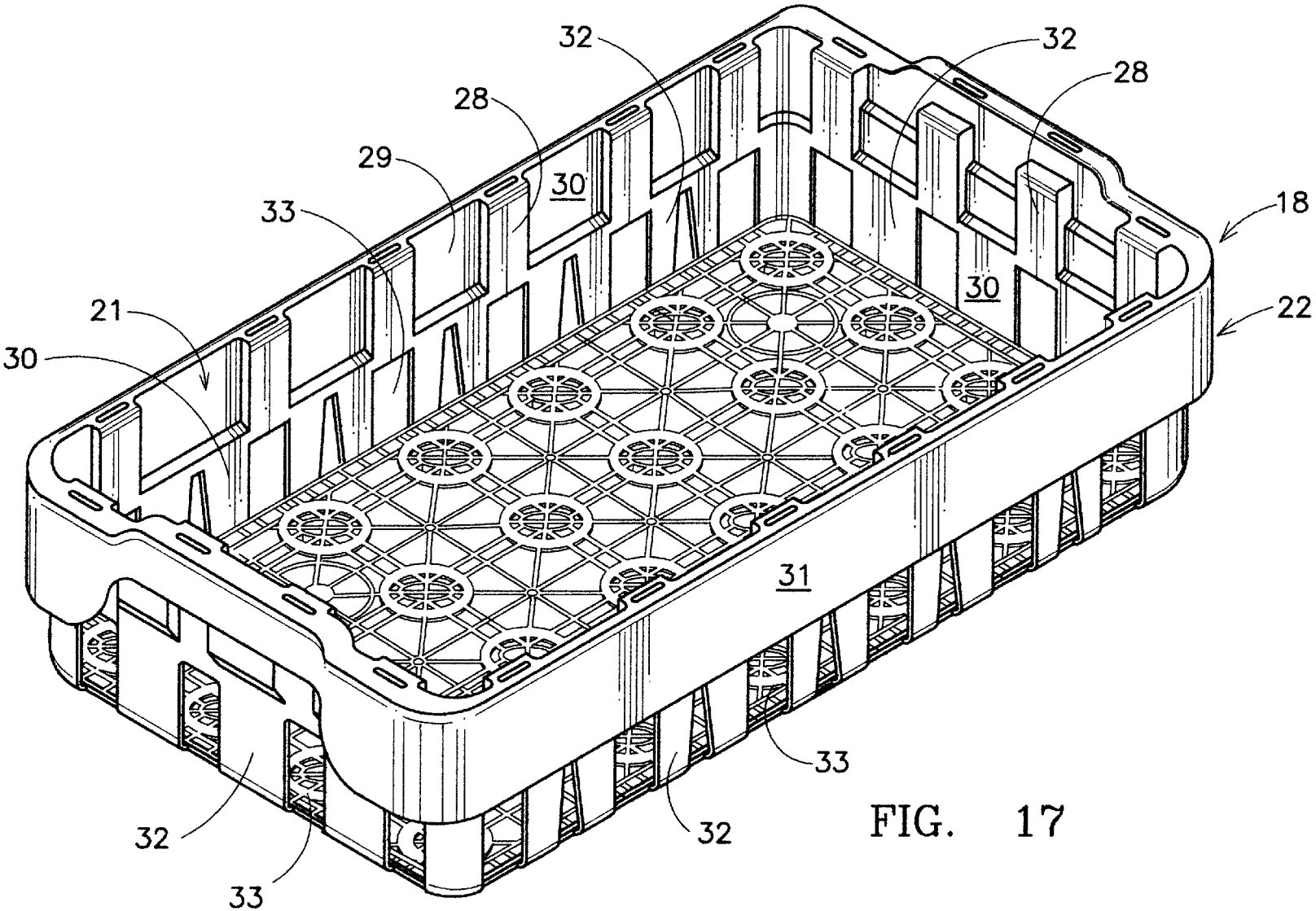
FIG. 17 is a perspective view of a fourth embodiment of the beverage bottle crate.

A fourth embodiment of the bottle is illustrated in FIG. 17. The retainer wall 18 includes an interior wall 21 providing the interior surface 30 to the retainer wall 18. An exterior wall 22 depends from the top 23 of the retainer wall to approximately the top of the lower wall portion 24 of the retainer wall 18. Thus, there exists a double wall construction for the upper portion 25 of the retainer wall 18.

A plurality of tangency pads 28 are spaced apart along the upper portion 25 of the retainer wall integral the interior surface 30. Wall sections are spaced apart on the lower portion 24 of the retainer wall forming the nesting windows 33 below each tangency pad 28. This crate 11 nests with other crates as previously described. The tangency pads 28 of a lower crate will mate with the windows of an upper crate, and the nesting steps 29 of a lower crate provide a nesting space for wall sections 32.

While we have disclosed the preferred embodiment of our invention, it is not intended that this description in any way limits the invention, but rather this invention should be limited only by a reasonable interpretation of the new recited claims.

Having thus described our invention, what we claim as new and desire to secure by Letters Patent is:

1. A nestable crate for bottles, said crate comprising:

a. a horizontally disposed floor having a top surface and a bottom surface;

b. a retainer wall integrally attached to the floor and extending along a periphery of said floor, said retainer wall having an upper portion, a lower portion, an interior surface and an exterior surface;

c. means, formed in the interior surface of the upper portion of the retainer wall, for contacting each bottle adjacent the retainer wall at a tangency point and a line of contact between the bottles and the retainer wall that is substantially parallel to the interior surface of the retainer wall, wherein said bottle contact means includes a plurality of spaced-apart tangency pads integrally formed on the interior surface of said retainer wall; and d. a nesting window formed in the interior surface of the lower portion of said retainer wall below each tangency point.

2. A nestable crate as defined in claim 1, wherein said crate includes a plurality of wall sections spaced apart and formed in the lower portion of the retainer wall, with wall section and said tangency pad having coplanar vertically disposed surfaces.

3. A nestable crate as defined in claim 2 further including a nesting step formed in the interior surface of the retainer wall between consecutive tangency pads.

4. A nestable crate as defined in claim 3 wherein said nesting step includes a section of the interior surface of the retainer wall between the tangency pads displaced toward the exterior surface of the retainer wall.

5. A nestable crate as defined in claim 4 further including a handle means mounted to the retainer wall.

6. A nestable crate as defined in claim 1 wherein said crate further includes an interior wall defining the interior surface of the retainer wall and an exterior wall defining the exterior surface of retainer wall, said exterior wall integrally connected to the interior wall to form a double-wall construction of the retainer wall.

7. A nestable crate as defined in claim 6 wherein said bottle contact means includes a plurality of spaced-apart tangency pads integrally formed on the interior surface of said retainer wall.

8. A nestable crate as defined in claim 7 wherein said crate includes a plurality of wall sections spaced apart and formed in the lower portion of the retainer wall defining the opening means below each tangency pad, with the wall section and said tangency pad having coplanar vertically disposed surfaces.

9. A nestable crate as defined in claim 8 further including a nesting step formed in the interior surface of the retainer wall between consecutive tangency pads.

10. A nestable crate as defined in claim 9 wherein said nesting step includes a section of the interior surface of the retainer wall between the tangency pads displaced toward the exterior surface of the retainer wall.

11. A nestable crate as defined in claim 10 wherein said crate further includes a nesting step, said nesting step includes a section of the interior retainer wall displaced toward the interior surface of the retainer wall.

12. A nestable crate as defined in claim 11 further including a handle means mounted to the retainer wall.

13. A nestable crate for bottles, comprising:

a. a horizontally disposed floor having a top surface and a bottom surface;

b. a retainer wall integrally attached to the floor and extending along a periphery of said floor, said retainer wall having an upper portion and a lower portion, said a disposed interior surface and an exterior surface;

c. a plurality of spaced-apart tangency pads integrally formed on the interior surface of said retainer wall, each said tangency pad contacting a bottle at a tangency point forming a line of contact with the bottles substantially parallel the interior surface; and, d. a nesting window in the lower portion of the retainer wall below each tangency pad;

e. a wall section in the lower portion of the retainer wall between consecutive nesting windows, with wall sections and said tangency pads having coplanar vertically disposed surfaces.

14. A nestable crate as defined in claim 13 further including a nesting step formed in the interior surface of the retainer wall between consecutive tangency pads.

15. A nestable crate as defined in claim 14 wherein said nesting step includes a section of the interior surface of the retainer wall between the tangency pads displaced toward the exterior surface of the retainer wall.

16. A nestable crate as defined in claim 15 wherein said crate further includes a nesting step, said nesting step includes a section of the interior retainer wall displaced toward the interior surface of the retainer wall.

17. A nestable crate as defined in claim 16 further including a handle means mounted to the retainer wall.

18. A nestable crate for bottles, said crate comprising:

a) a horizontally disposed floor having a top surface and a bottom surface;

b) a retainer wall integrally attached to the floor and extending around the periphery of the floor, said wall having an upper portion, a lower portion, a vertically disposed interior surface and an exterior surface;

c) means, formed in the upper portion of the retainer wall on the interior surface, for contacting the bottles at a tangency point on each bottle, and a line of contact between the bottles in the crate, said tangency point is a point in said line of contact, wherein said bottle contact means includes a plurality of spaced-apart tangency pads integrally formed on the interior surface of said retainer wall; and, d) a nesting window formed in the lower portion of the retainer wall interior surface below each point of contact between the retainer wall and bottle.

19. A nestable crate as defined in claim 18 wherein said crate includes a plurality of wall sections spaced apart and formed in the lower portion of the retainer, with wall section and said tangency pad having coplanar vertically disposed surfaces.

20. A nestable crate as defined in claim 19 further including a nesting step formed in the interior surface of the retainer wall between consecutive tangency pads.

21. A nestable crate as defined in claim 20 wherein said nesting step includes a section of the interior surface of the retainer wall between the tangency pads displaced toward the exterior surface of the retainer wall.

22. A nestable crate as defined in claim 21 further including a handle means mounted to the retainer wall.

23. A nestable crate as defined in claim 18 wherein said crate further includes an interior wall defining the interior surface of the retainer wall and an exterior wall defining the exterior surface of retainer wall, said exterior wall integrally connected to the interior wall to form a double-wall construction of the retainer wall.

24. A nestable crate as defined in claim 23 wherein said bottle contact means includes a plurality of spaced-apart tangency pads integrally formed on the interior surface of said retainer wall.

25. A nestable crate as defined in claim 24 wherein said crate includes a plurality of wall sections spaced apart and formed in the lower portion of the retainer wall defining the opening means below each tangency pad, with the wall section and said tangency pad having coplanar vertically disposed surfaces.

26. A nestable crate as defined in claim 25 further including a nesting step formed in the interior surface of the retainer wall between consecutive tangency pads.

27. A nestable crate as defined in claim 26 wherein said nesting step includes a section of the interior surface of the retainer wall between the tangency pads displaced toward the exterior surface of the retainer wall.

28. A nestable crate as defined in claim 27 wherein said crate further includes a nesting step, said nesting step includes a section of the interior retainer wall displaced toward the interior surface of the retainer wall.

29. A nestable crate as defined in claim 28 further including a handle means mounted to the retainer wall.

30. A nestable crate for bottles, comprising:

(a) a horizontally disposed floor having a top surface and a bottom surface;

(b) a retainer wall attached to the floor, said retainer wall having a double wall construction including an interior wall attached to the floor and an exterior wall attached to the interior wall, and said retainer wall having two end walls and two side walls, and said retainer wall having an upper portion and a lower portion, and said upper portion of the retainer wall having a plurality of vertically disposed surfaces on the interior wall for supporting bottles, and said vertically disposed surfaces are space apart along the respective side wall and end wall along which the vertically disposed surfaces extend, whereby said vertically disposed surfaces are coplanar along respective side walls and end walls and, wherein said lower portion of said retainer wall includes a wall section along the interior wall disposed between each consecutive pair of nesting windows, and each said wall section having a vertically disposed surface that is coplaner with a vertically disposed surface in the upper portion of the respective side wall or end wall within which a wall section is formed, and each said wall section is attached to the floor, (c) a plurality of nesting windows in the lower portion of the interior of the wall of the retainer wall, and each said nesting window is below a vertically disposed surface on the upper portion of the interior wall, wherein said crate further includes a nesting step formed on the retainer wall between consecutive vertically disposed surfaces on the upper portion of the interior wall.

31. A nestable crate, as defined in claim 30, wherein said nesting step includes a section of the upper portion of the interior of the wall between consecutive vertically disposed surfaces displaced from the vertically disposed surface toward the exterior wall of the retainer wall.

32. A nestable crate, as defined in claim 31, wherein said lower portion of the retainer wall has a cross-sectional width that is greater than a cross-sectional width of the upper portion of the retainer wall.

33. A nestable crate, as defined in claim 32, wherein said retainer wall includes a top extending along said retainer wall and between the exterior wall and interior wall.

34. A nestable crate, as defined in claim 33, wherein said lower portion of the retainer wall has a cross-sectional width that is greater than a cross-sectional width of the upper portion of the retainer wall.

35. A nestable crate for bottles, comprising:

(a) a horizontally disposed floor having a top surface and a bottom surface;

(b) a retainer wall attached to the floor, said retainer wall having a double wall construction including an interior wall attached to the floor and an exterior wall attached to the interior wall, and said retainer wall having two end walls and two side walls, and said retainer wall having an upper portion and a lower portion, and said lower portion of the retainer wall having a cross-sectional width greater than the cross-sectional width of the upper portion of the retainer wall, and said upper portion of the retainer wall having a plurality of vertically disposed surfaces on the interior wall for supporting bottles, and said vertically disposed surfaces are spaced apart along the respective side wall and end wall along which the vertically disposed surfaces extend, whereby said vertically disposed surfaces are coplanar along respective side walls and end walls; and, (c) a plurality of nesting windows in the lower portion of the interior of the wall of the retainer wall, and each said nesting window is below a vertically disposed surface on the upper portion of the interior wall, whereby the vertically disposed surfaces of a lower empty crate nests within the nesting window of an upper crate stacked on top of the lower crate;

(d) a wall section on the lower portion of the interior wall disposed between each consecutive pair of nesting windows, and each said wall section having a vertically disposed surface that is coplanar with the vertically disposed surface in the upper portion of the respective side wall or end wall within which a wall section is formed, and each said wall section is attached to the floor; and, (e) a nesting step in the retainer wall between consecutive vertically disposed surfaces on the upper portion of the interior wall of the retainer wall, whereby the wall sections on said upper crate nests adjacent the nesting steps of the lower empty crate.

36. A nestable crate for bottles, comprising:

(a) a horizontally disposed floor having a top surface and a bottom surface;

(b) a retainer wall attached to the floor, said retainer wall having a double wall construction including an interior wall attached to the floor and an exterior wall integral with the interior wall, and said retainer wall having two end walls and two side walls, and the interior wall having an upper portion and a lower portion, and the exterior wall having an upper portion integral the upper portion of the interior wall, and said retainer wall having a plurality of vertically disposed surfaces on the upper portion of the interior wall for supporting bottles, and said vertically disposed surfaces are space apart along the respective side wall and end wall along which the vertically disposed surfaces extend, whereby said vertically disposed surfaces are coplanar along respective side walls and end walls; and, wherein said lower portion of said retainer wall includes a wall section along the interior wall disposed between each consecutive pair of nesting windows, and each said wall section having a vertically disposed surface that is coplaner with a vertically disposed surface in the upper portion of the respective side wall or end wall within which a wall section is formed, and each said wall section is attached to the floor, (c) a plurality of nesting windows in the lower portion of the interior wall of the retainer wall, and each said nesting window is below a vertically disposed surface in the upper portion of the interior wall, wherein said crate further includes a nesting step formed on the retainer wall between consecutive vertically disposed surfaces on the upper portion of the interior wall.

37. A nestable crate, as defined in claim 36, wherein said nesting step includes a portion of the interior of the wall displaced from the vertically disposed surface toward the exterior wall of the retainer wall.

38. A nestable crate, as defined in claim 37, wherein said retainer wall includes a top extending along said retainer wall and between the exterior wall and interior wall.

* * * * *